US005203255A

United States Patent [19]

Wells et al.

[11] Patent Number: 5,203,255

[45] Date of Patent: Apr. 20, 1993

[54] HOT COUNTERTOP SELF-SERVICE FOOD STATION

[75] Inventors: Cindie M. Wells, McFarland; Scott A. Halverson, Poynette; John A. Jonovic, Madison, all of Wis.

[73] Assignee: Oscar Mayer Foods Corporation, Madison, Wis.

[21] Appl. No.: 691,255

[22] Filed: Apr. 25, 1991

[51] Int. Cl.[5] ..... A21B 1/00; A23L 1/00; A47B 77/08; A47F 3/14

[52] U.S. Cl. ..... 99/468; 62/252; 62/255; 99/476; 99/483; 126/21 A; 165/918; 219/214; 219/400

[58] Field of Search ..... 99/448, 467, 468, 473, 99/474–476, 333, 483, 484; 165/918; 312/236; 219/214, 400; 62/251, 252, 255, 256; 126/21 A

[56] References Cited

U.S. PATENT DOCUMENTS

| | | | |
|---|---|---|---|
| 3,010,290 | 11/1961 | Fredrick | 62/251 |
| 3,120,599 | 2/1964 | Hilgers | 219/214 |
| 3,327,092 | 6/1967 | Wilson | 219/214 |
| 3,643,808 | 2/1972 | Ryan et al. . | |
| 3,719,408 | 3/1973 | Fullington et al. | 312/236 |
| 3,911,248 | 10/1975 | Buday et al. | 219/400 |
| 3,999,475 | 12/1976 | Roderick | 99/474 |
| 4,062,983 | 12/1977 | Roderick | 126/21 A |
| 4,074,108 | 2/1978 | King | 219/214 |
| 4,331,243 | 5/1982 | Doll . | |
| 4,343,985 | 8/1982 | Wilson et al. | 219/214 |
| 4,416,380 | 11/1983 | Flum . | |
| 4,458,501 | 7/1984 | Kooy | 62/256 |
| 4,531,646 | 7/1985 | Howard . | |
| 4,627,542 | 12/1986 | Fredrickson . | |
| 4,850,120 | 7/1989 | Stein | 99/474 |

FOREIGN PATENT DOCUMENTS

| | | | |
|---|---|---|---|
| 1026111 | 2/1978 | Canada | 312/236 |
| 2550432 | 2/1985 | France | 312/236 |
| 8705283 | 9/1987 | PCT Int'l Appl. | 219/214 |

OTHER PUBLICATIONS

HATCO Product Brochure, Sep. 1988, HATCO Corporation, Milwaukee, Wis.

*Primary Examiner*—Timothy F. Simone

*Attorney, Agent, or Firm*—Lockwood, Alex, FitzGibbon & Cummings

[57] ABSTRACT

A new and improved hot oven countertop display station is provided in a hot oven countertop display unit having a reclosable front door panel opening and an integral upper sign and menu board structure. A dispenser display rack is provided in the oven compartment for supporting flanged food packages in gravity feed arrays of columns and rows terminating at the front door opening. The rack has been designed to reduce or eliminate the presence of any heated rack surfaces at the front opening of the oven. An optional refrigerated condiment dispensing display may be located adjacent the hot oven display to complete the self-service food station. The hot oven countertop food station provides a clean and safe arrangement for displaying and storing pre-cooked pre-heated ready-to-eat foods for extended periods of up to four hours until purchased by the self-service customer.

6 Claims, 6 Drawing Sheets

HOT COUNTERTOP SELF-SERVICE FOOD STATION

BACKGROUND OF THE INVENTION

The present invention relates to self-service food displays for use in restaurants, cafeterias, convenience stores, quick service food marts, airports, shopping malls or other locations where fast foods are served. More particularly, it relates to a new and improved countertop display station including a warming oven and oven display rack for storing pre-cooked and pre-heated foods in certain merchandising containers at elevated temperatures for extended periods of time without any significant deterioration in food quality.

Self-service displays are especially desirable to fast food convenience store operators primarily because once loaded, they generally do not further require operator attention. This permits the store owner to offer a larger variety of goods without increasing the associated labor costs, because personnel are not required to be on hand to personally serve the customers for these products. Numerous self-service displays have been developed for presenting various foods to fast food customers. Many displays have included metal or plastic racks which arrange the products in columns and rows set at a downwardly slanted angle, such that when the front-most item in a column is removed, the remaining items in that column will move downwardly and forwardly to re-face themselves to the customer. In this manner, all of the positions of product at the front of the rack are completely filled. This self-facing feature, provided by angling the front, customer-facing side of each row downwardly so that product is fed by gravity to the front of the display rack for removal by the customer has long been shown to improve display appearance and promote stock rotation promoting freshness. Store owner attention is not required until all of the items stored in that particular column or row have been depleted.

The store owner, in accordance with these prior art racks, simply needs to set up the self-service displays prior to opening the establishment or during slow periods. Thereafter, the salespersons may generally leave them all day or re-stock them from time to time, at a convenient time, as necessary without requiring the store owner to hire additional employees. Various display racks of this type are well known for use in refrigerated environments for dispensing milk, beer and soda, as well as, for displaying snack items at room temperature on a counter.

The angle feed display racks for food items used in the past have generally not been used in hot oven contexts for customer self-service for several reasons. Store owners are wary of placing hot ovens within the reach of a customer. Most prior art gravity feeding, self-facing, self-service merchandise displays include forward stop structures that extend substantially within the product removal face of the display racks. In a hot oven environment or heated enclosure environment, these heated metallic surfaces in the product removal face are likely to burn the customers. Accordingly, where heated countertop displays have been provided, they have usually been kept behind the counter, away from the customer, thereby requiring a cashier or salesperson to leave the cash register unattended in order to remove items from the oven, which is undesirable.

Another major reason why hot food displays have not been widely used is that for most foods, particularly convenience foods including sandwiches having a bun or bread portion, the food quality tends to deteriorate rapidly in a heated environment. The bread portions tend to loose their texture and freshness in a short period of time. Prior efforts to retard or avoid deterioration in food quality have included providing warming ovens with controlled humidity enclosures. These displays tend to be rather expensive and generally food quality deterioration is still observed in an undesirably short period of time, especially with bread products.

Other efforts to slow the loss in freshness or quality have included the use of microwaves to rapidly reheat convenience food items at the point of sale. Once again, this creates the need for sales personnel to interrupt their cashier function to place the foods in microwaving ovens and to handle the foods to the customer for sale. The microwaving step takes time and often some customers don't want to wait, thereby removing the convenience aspect of the fast foods.

More recently, improvements in the food packaging industry have led to the development of new and improved merchandising containers having special barrier properties which permit pre-heated and pre-cooked foods to be stored at elevated temperatures for extended periods of time of up to several hours. Foods packaged in these specialty containers retain their original moisture and texture and do not become either hard or soggy after prolonged exposure to elevated temperatures. The new and improved merchandising containers are described in commonly assigned, co-pending applications U.S. Ser. No. 451,433 filed Dec. 15, 1989 and U.S. Ser. No. 687,266 filed Apr. 18, 1991.

As described in these pending applications, the merchandising containers are one-piece hinged boxes or containers molded from formed synthetic thermoplastic materials. The containers are generally clear or see-through and are sized and shaped to merchandise and store ready-to-eat food products in a manner which allows the food products to be consumed immediately without assembly, heating or other handling procedures. These packages may be provided in generally any desired size and shape. Nevertheless, these merchandising containers generally include a lower receptacle tray portion and a cover portion having a peripheral lip that imparts an overlocking lid characteristic to provide a tight interference fit of the cover portion over the tray receptacle portion. A locking assembly is provided to keep the container closed when only the cover portion of the container is grasped by the customer when a container is being lifted and transported. Containers of this type are now capable of providing long-term, high quality heated storage for food products as hamburger sandwiches, hot dog sandwiches, breakfast items such as sausage and biscuit combinations, as well as, other sandwiches and the like, incorporating meats and or cheeses within bread, a bun or other dough-like food item. It has long been desired to provide self-service merchandising of food products of this type for use at various convenience store locations.

Accordingly, it is an object of the present invention to provide a new and improved self-service countertop display for heated foods packaged in the new and improved merchandising food packages referred to above.

It is another object of the present invention to provide a new and improved countertop hot oven display and self-service food station which presents pre-cooked and pre-heated food packages to the customer in a manner which provides a minimum risk of burning the customer when the customer removes product from the heated display.

It is a further object of the present invention to provide a new and improved hot oven countertop display for self service environments capable of accommodating and displaying a variety of packaged pre-cooked and pre-heated self service convenience foods in a controlled temperature environment which does not require a means for controlling the humidity of said environment.

It is still another object of the present invention to provide a neat, organized and clean self-service countertop food display station at which a customer may prepare pre-cooked and pre-heated food products for immediate consumption without requiring handling or other serving assistance by convenience store personnel.

SUMMARY OF THE INVENTION

In accordance with these and other objects, the present invention provides a new and improved hot oven countertop self-service food station for use with flanged merchandizing containers. The merchandizing containers include a lower tray receptacle portion, a hingedly connected lid or cover portion, and releasable latch means for locking the tray and cover portions in a closed position. Typically, in the closed position the merchandizing container has a generally rectangular configuration which includes a height dimension defined between the parallel opposed top and bottom surfaces of the cover and tray portions, respectively. The merchandizing containers include an outwardly extending peripheral flange portion disposed intermediate the height of the containers. Cooperating structures for providing a tight fit between the tray and cover portions may be defined along the peripheral flange areas. The packages should have sufficient rigidity when closed and locked to be fully supported in a filled condition solely by their projecting peripheral flange portions. Preferably, the merchandizing containers are made from a thermoplastic material having vapor and moisture barrier/permeability properties which permit pre-cooked and pre-heated food products, especially those including a bread portion, to be maintained therein at elevated temperatures for prolonged periods of time of up to several hours without permitting deterioration of food product quality.

In accordance with this invention, the new and improved food service station comprises an arrangement including a display oven; a self-facing, user friendly, storage/display rack disposed in the display oven; a temperature control means including hot air circulation means for maintaining the oven and food products at a desired heated storage temperature, e.g., from about 140° to about 180° F. or more, preferably between about 150° and 165° F., inclusive.

The display rack of the invention comprises a generally U-shaped frame member including a base and a pair of opposed upstanding side panels. A plurality of angled shelves are defined between the left and right upstanding side panels by aligned and opposed pairs of left-hand and right-hand angled side rails connected to the upstanding side panels and forward and rear spaced and opposed transverse cross members connected to said angled side rails. Both the forward and rear cross members are recessed with respect to the front and rear planes or major surfaces of the frame, respectively, and are connected to the angled side rails so that they are at intermediate locations along the length of the angled side rails, i.e., the cross members are spaced inwardly from the respective ends of the angled side rails.

In accordance with the invention, each of the angled shelves are further subdivided to form a plurality of side by side product-receiving chutes or columns by means of raised product guide rails attached to the frame and shelf-defining members. The guide rails generally extend above and perpendicularly with respect to the forward and rear transverse cross members and generally parallel to said angled side rails on their respective shelves. The raised product guide rails defining each product column on each row or shelf are adapted to slidably receive and support a given package size and width. Some of the intermediate raised product guide rails are removable and reversible to provide an alternate or adjustable product channel width. The guide rails are provided with curved or bended end fingers which function as forward product holding stops for packages slidably received in each column. The rack further includes mounting means for mounting the removable guide rails to the forward and rear cross members of each shelf. The mounting means preferably includes means for adjusting the position of the removable guide rails to change the width of the product guide channels, as desired, to accommodate two different sized packages.

In the preferred embodiment, the entire rack member is formed of bended stainless steel rod or wire which is fused or welded together at various locations to form the frame and shelf forming members, as well as, the column guide rail members. In accordance with the structure and function of the rack of the invention, the product packages are displayed by resting the outwardly projecting lateral flange portions of each package on the raised guide rail surfaces forming its respective product column. The back to front downwardly sloping or angled orientation for each shelf provides for a sliding gravity feeding of the packages toward the forward stops in each column, when loading a column from the back or removing a package from the front. The structure of the rack is specially designed to present a minimum surface area of heated metallic surfaces at the product removal or front face of the rack and at the product loading or back face of the rack. A major feature provided by the rack of this invention is that a fast food customer may directly grasp any one of a number of differently sized packages in the center of the package, contacting the top and bottom surfaces of the package for lifting it out of the rack or, just the cover may be grasped to lift and remove the package from the rack, with little or no risk of inadvertently contacting a hot rack surface. Moreover, the cashier or store person loading the packages in the rear side of the oven and rack also benefits from the reduction in heated surfaces at the rear face of the rack as well.

The countertop display oven of this invention includes a lower generally rectangular windowed case or oven body having at least one reclosable door-panelled opening adapted to be placed on a countertop. The oven body defines a generally rectangular interior oven compartment configured to receive the new and improved hot food display rack of the invention therein with sufficient air flow clearance on all sides to provide controlled, generally uniform air flow and heating. Heater means of a forced hot air type is disposed or mounted adjacent the oven body in air flow communication with the interior compartment. Temperature controller means including temperature sensing means are also provided to automatically turn the heater means on and off in use to achieve the desired air flow and temperature regulation. Preferably, a modified air discharge tube is also provided in the interior compartment for introducing a flow of hot forced air throughout the height and volume of the oven. The modified air discharge tube provides improved air flow along the peripheral edge portions of the compartment adjacent the glass surfaces, thereby improving uniform temperature control and minimizing undesirable occurrence of condensation within product packages caused by cold spots and temperature gradients. Also, in the preferred embodiment, the oven cabinet is illuminated by incandescent bulbs and fixtures located in lighting recess areas defined along the inner surface of the top wall of the oven compartment.

The countertop oven display of the present invention preferably includes an integral upper frame portion defined by extended corner members projecting above the top wall of the oven body and a plurality of panel members extending between the corner members to define a generally four-sided shroud area. A cover panel or lid having a depending peripheral flange portion may be telescopically placed over the shroud area and secured to the cover posts to completely enclose the upper frame shroud area. The panel members for the upper frame area may include menu boards, signs, graphics, display panels, photographic display panels, promotional announcement displays and the like which may be secured to the corner post extensions forming upper frame areas. Preferably, rectangular groove means are defined on each side of each corner post to cooperatively define an open-topped, panel-receiving slot along each side of the upper frame area for slidably receiving the menu boards and display panels. In the preferred embodiment at least some of the sides of the shroud are formed by a pair of panels including a lower opaque graphics panel and an upper graphics panel having translucent portions and the upper shroud area includes illumination means for providing a back-lit sign display. The integral upper shroud area not only provides a built-in attractive signage feature, but also serves to cover up electrical and mechanical equipment from view which are mounted adjacent the top wall of the oven saving valuable counterspace and providing a more attractive self-service display.

In accordance with the invention, the display oven is preferably provided with a black anodized surface finish to visually frame the food product contents for improved sales appeal. The display oven will have at least a front door opening, but preferably, will also have an opposed rear door opening to provide a pass-through door structure to the interior compartment. The rear door permits the store owner to add new packages of food product as needed from the back of each column, from behind the counter ensuring front-feeding stock rotation as desired. If the oven is provided with only a single front door, means may be provided to turn the rack within the oven to permit loading of new product at the rear of the rack. Alternatively, means may be provided to slide the rack fully out of the oven compartment to permit loading access at the rear side of the rack.

The new and improved hot oven self-service countertop food station of the present invention provides a clean and safe arrangement for displaying and storing pre-cooked, pre-heated and ready-to-eat foods for reasonably extended periods of time of up to, for example, about four hours without deterioration of food quality until purchased by the customer for immediate consumption. An optional refrigerated or cooled condiment dispensing display may be located immediately adjacent the oven display to fully complete the self-service food station of this invention.

Other objects and advantages of the present invention will become apparent from the following detailed description of the invention taken in conjunction with the drawings, in which:

DETAILED DESCRIPTION OF THE PREFERRED EMBODIMENT

Figure 1:
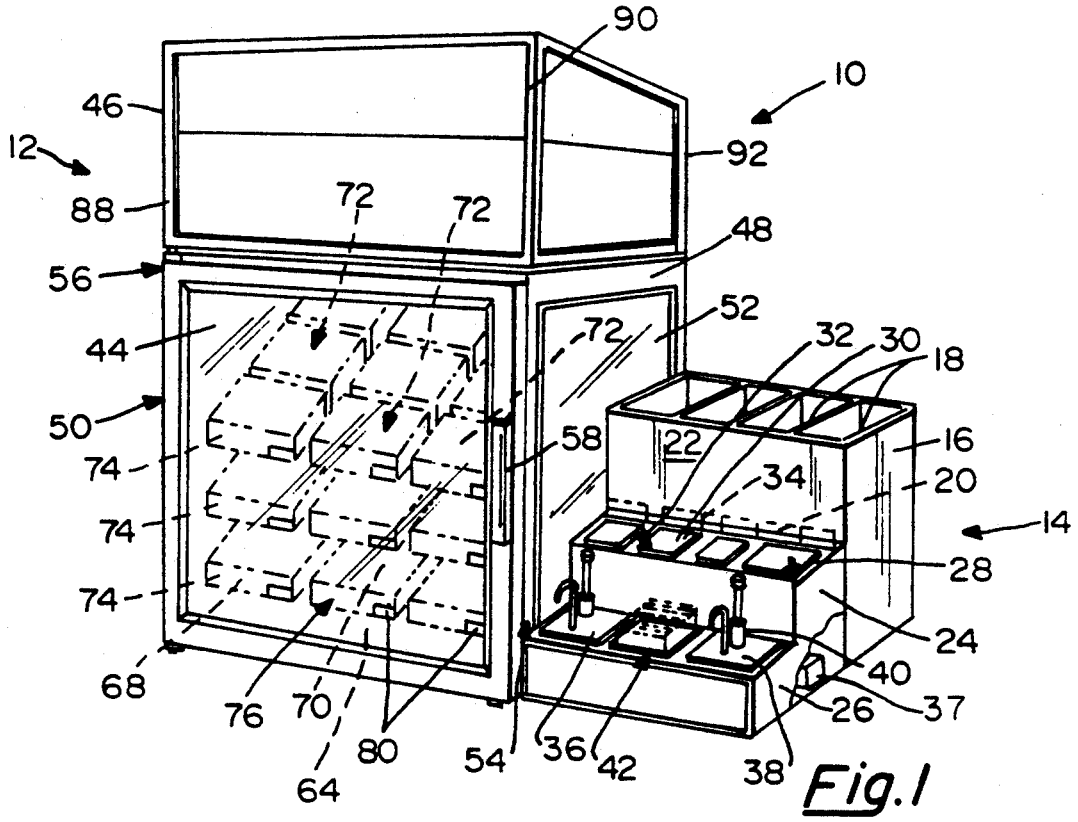
FIG. 1 is a perspective view of the new and improved self service countertop hot food station of the present invention including the display oven, display rack and condiments tray side car as shown and including a plurality of different food packages arranged in rows and columns presented by the display rack in the display oven.

Referring now to FIG. 1, the preferred embodiment of the new and improved hot food countertop self-service station, generally referred to by reference numeral 10, is shown. Self service station 10 includes a countertop oven display assembly 12 and a refrigerated or cooled condiments server 14. Condiment server 14 includes a rear condiment envelope or portion pack bin storage feeder section 16 with top loading openings 18 and lower gravity feed product removal openings 20. A sign area or front display wall 22 is provided on the front side of the portion pack storage feeder section 16. Condiment server 14 has a forwardly projecting body having a stepped configuration defining an middle tier receptacle area 24 and a lower tier area 26. Middle tier 24 includes recessed areas for receiving rectangular metal bays or trays 28 equipped with hinged clear plastic lids 30 and spoon 32 each adapted to hold loose fresh condiments 34, such as pickles, relishes, onions and the like at refrigerated temperatures. Lower tier area 26 includes a pair of bays 36 and 38 equipped with hand pump dispensers 40 for serving ketchup and mustard. Napkins may be stored in a central receptacle area 42 in lower tier 26 as shown. Condiments server 14 includes refrigeration means in the body portion to keep the items chilled throughout the day, such as an electrical refrigeration unit 37 or alternatively, a manually filled or loaded ice or ice pack receiving area under the bays 28.

Figure 8:
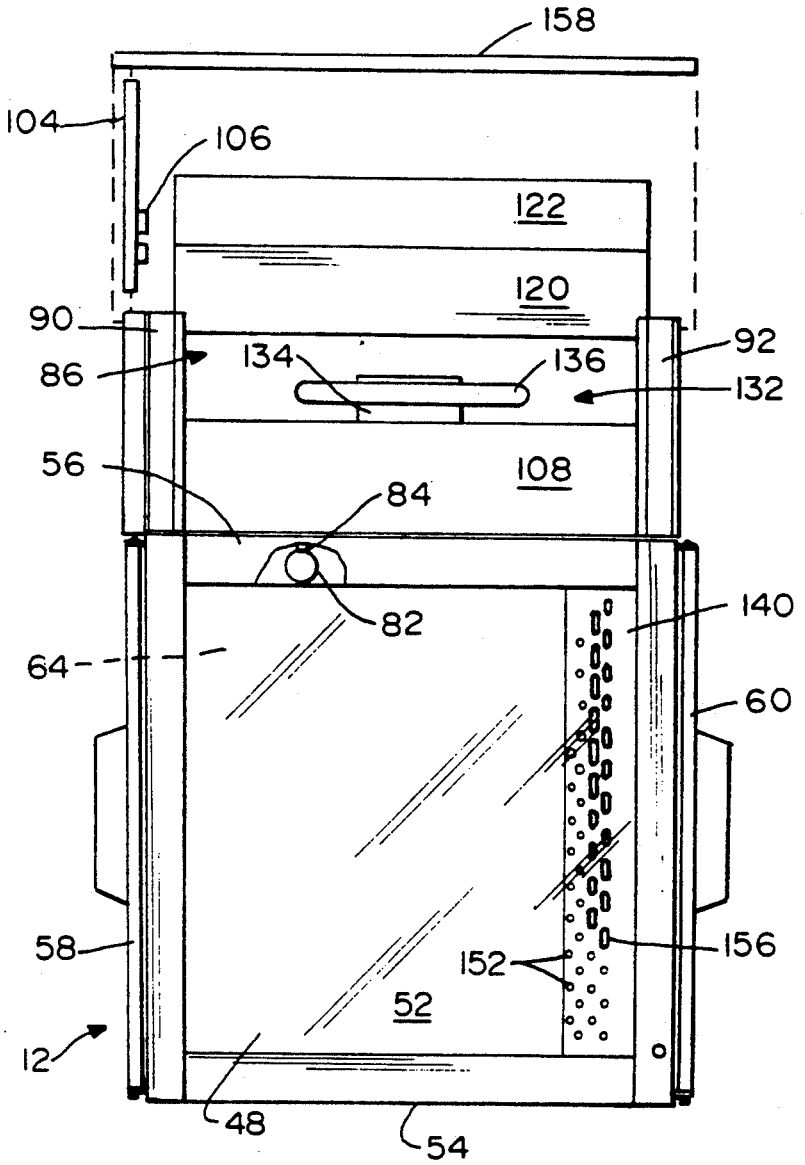
FIG. 8 is an exploded side elevation view of the upper frame portion of the new and improved hot food countertop display oven of the invention.
Figure 10:
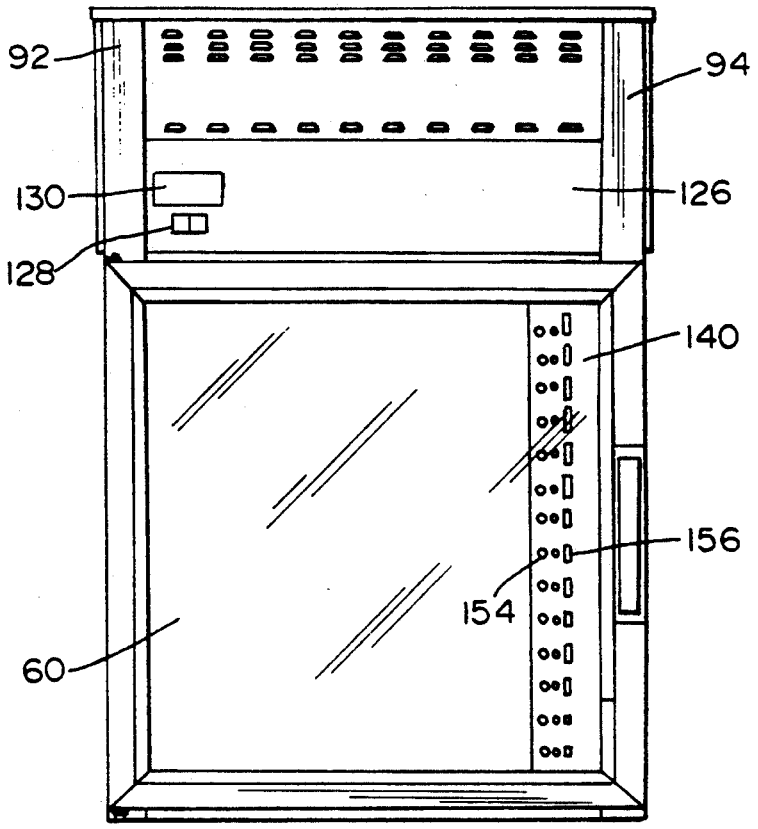
FIG. 10 is an elevated rear end view of the new and improved display oven of the invention with the display rack removed.

Oven display assembly 12 includes a lower food-receiving portion 44 and an upper frame and marquis portion 46. Lower food-receiving oven portion 44 includes a glass walled or windowed oven body 48 having a pair of parallel, spaced apart upstanding sidewalls 50 and 52 inter-connected by a bottom wall 54 and an opposed top wall 56. Oven body 48 is preferably provided with a double-doored pass-through body design including a hinged front door panel 58 and a hinged rear door panel 60 (FIGS. 8 and 10). Alternatively, oven body 48 may be provided with a solid rear wall panel such as panel 62 shown in the embodiment depicted in FIG. 4.

Figure 2:
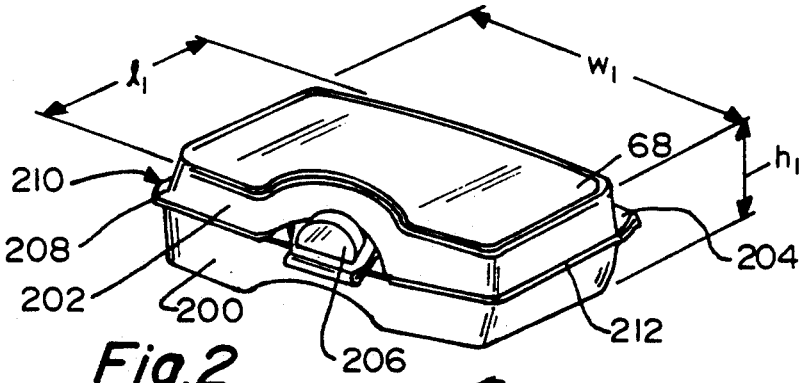
FIG. 2 is a perspective view of an elongate generally rectangular food receiving package of the type configured for receiving a hot dog or sausage in a bun.
Figure 3:
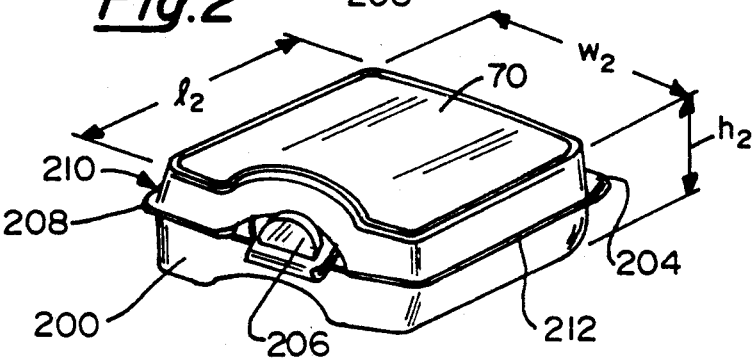
FIG. 3 is a perspective view of another food-receiving package, as in FIG. 2, but depicting a flanged food package adapted to receive an egg/muffin sandwich, sausage/biscuit sandwich or hamburger sandwich type of product.

Oven body 48 defines a generally rectangular heated compartment or enclosure 64 adapted to receive a new and improved hot oven display rack 66 (FIG. 4) for displaying and storing a variety of pre-cooked, preheated foods in different sized flanged packages, such as packages 68 and 70 shown in FIGS. 2 and 3, respectively. As shown in the preferred embodiment in FIG. 1, in a fully stocked or loaded condition, display rack 66 presents the hot food packages 68 and 70 in a matrix array of display positions defined by three columns 72 and three rows 74 so that nine individual packages such as 68 and 70 are arrayed at the front or customer service side 76 of the rack 66 immediately adjacent the front door panel 58 at front opening 78 to compartment 64. Small rectangular clip-on column identifier tags 80 can be affixed to the front side 76 of rack 66 and displayed at the front opening 78 in a manner to be described more fully below.

Figure 4:
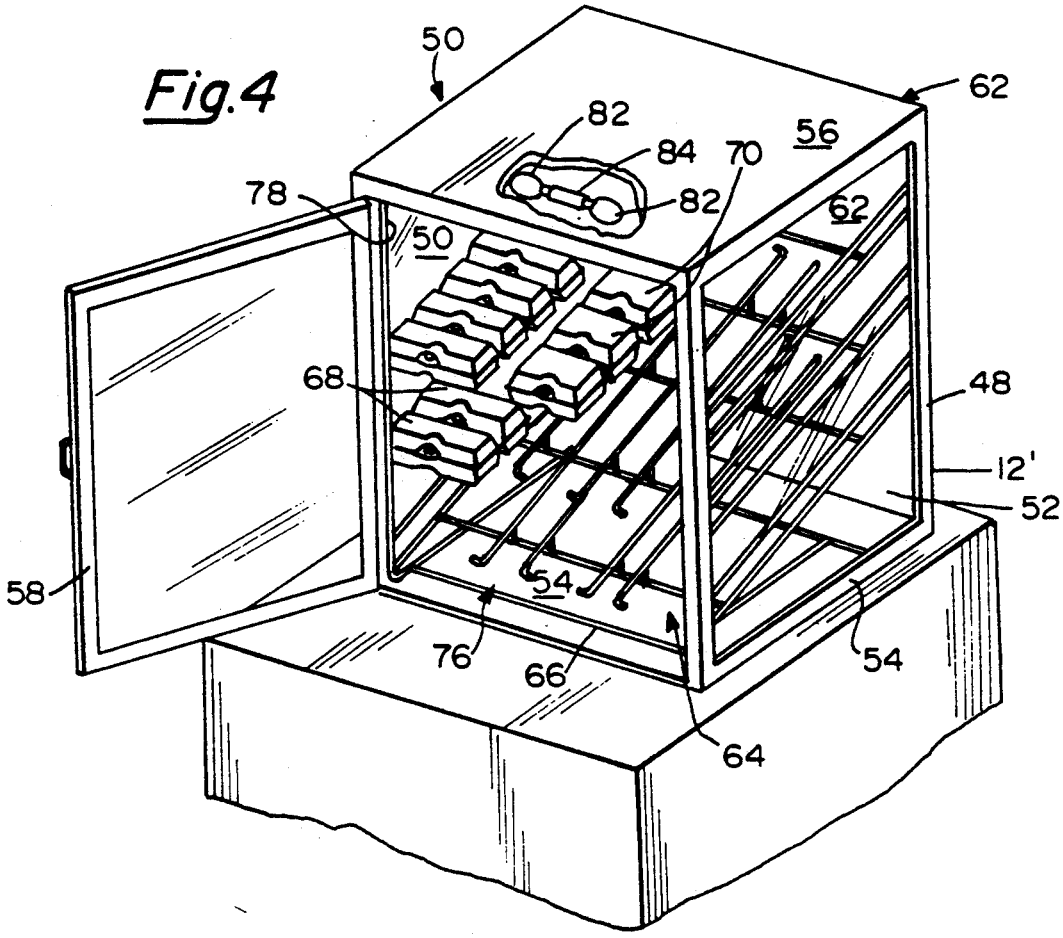
FIG. 4 is a perspective view of the new and improved countertop display oven of the invention with the upper frame structure removed and showing the display rack in its installed position in the oven with product packages disposed in the front product removal face of the rack and oven.
Figure 6:
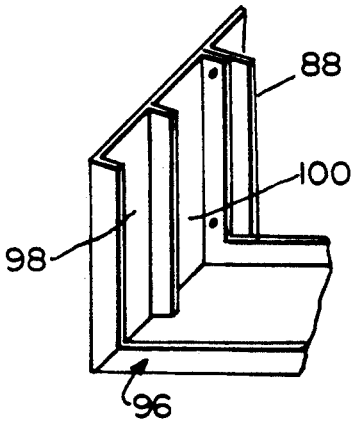
FIG. 6 is a fragmentary perspective view of a portion of a slot-defining mounting bracket adapted to slidably receive a front menu display panel in the upper frame portion shown affixed to the exterior of a corner extension of the new and improved display oven of the invention.

Moreover, in the preferred embodiment 10, the oven compartment 64 is illuminated by a plurality of recessed incandescent light bulbs 82 secured in a double sided fixture 84 located near front door 58, as shown in phantom in FIG. 4.

Referring now to FIGS. 6, 8, 10 and 11, integral upper frame portion 46 of oven display assembly 12 comprises an upper four sided shroud area 86 formed by four vertically extending corner posts 88, 90, 92 and 94 extending upwardly from top wall 56 from each of the corners of oven body 48. A front menu board mounting bracket 96 including a front and rear pair of rectangular slot forming grooves 98 and 100, respectively, is affixed to the front sides of corner posts 88 and 90 as indicated by welding sites 102 in FIG. 6. Mounting bracket 96 is adapted to slidably receive a graphics display and menu board 104 having changeable price display mechanisms 106 projecting from the back surface thereof (FIG. 8).

Each of the corner posts 88, 90, 92 and 94 are interconnected with metal side plates 108 having a height of about six inches. Metal plates 108 serve to stabilize the upper frame 46 and guarantee an opacity to the lower portions of the shroud sign areas. A single track or slot mounting bracket 110 is provided on shroud sides 112 and 114, (FIG. 11) similar to front bracket 96, but having only a single groove 116, similar to groove 100.

The side brackets 110 are adapted to receive a split panel structure (shown in FIG. 8) including an opaque lower graphics panel portion 120 and a longer upper translucent graphics panel portion 122. The rear side 124 of the upper shroud area 86 shown in FIG. 10 includes a lower opaque control panel 126 having an on/off switch 128 and an adjustable thermostatic temperature regulator control 130 and an upper opaque air vent panel 132 for venting hot air generated by the light and electrical and mechanical works in the shroud area 86. Panel 126 may have operator instructions or directions affixed to it or printed on it.

Figure 11:
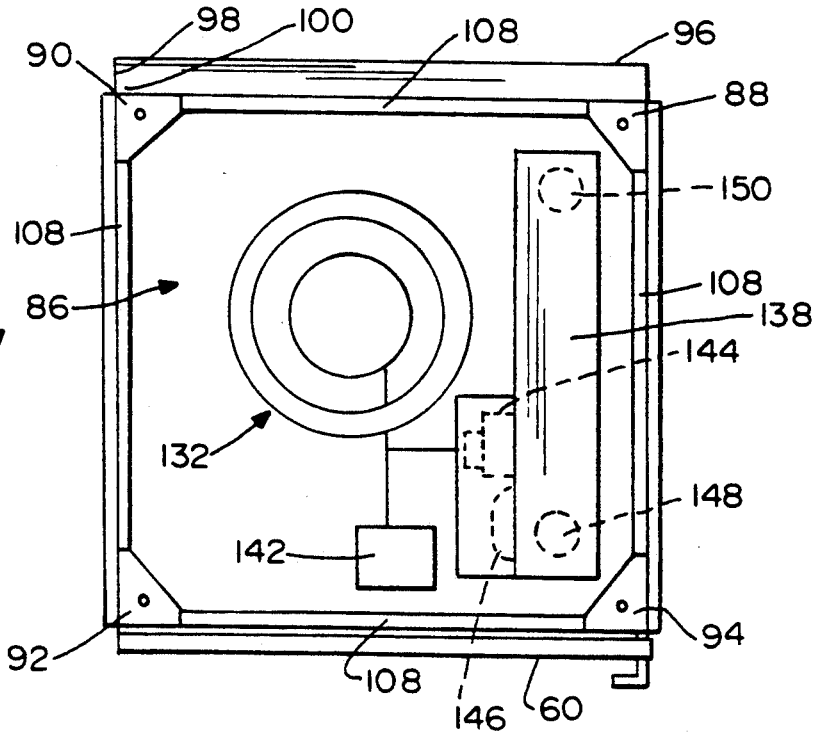
FIG. 11 is a top plan view of the shroud area within the upper frame portion of the display oven, showing the attached appliances in schematic form.
Figure 12:
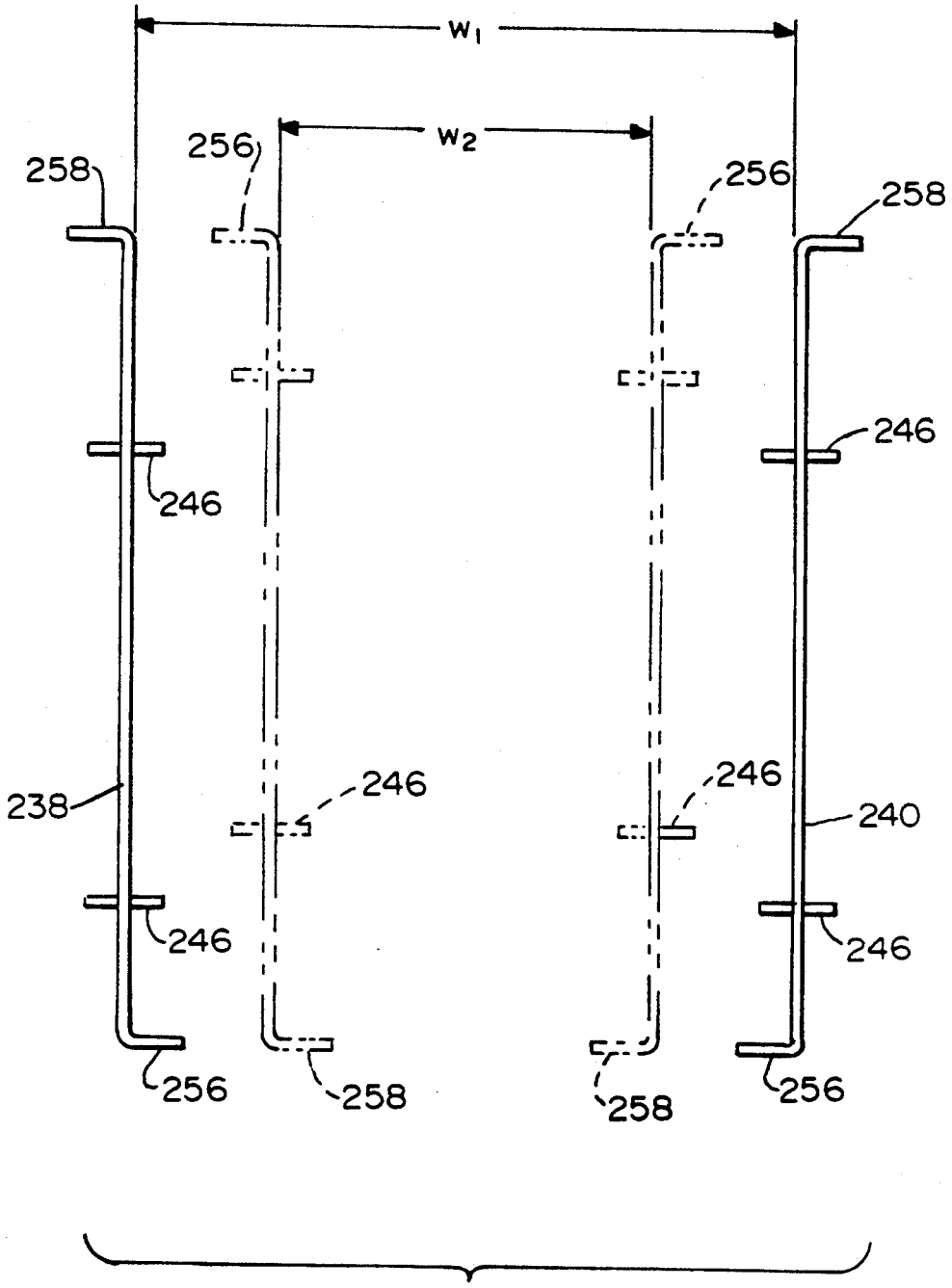
FIG. 12 is a top plan view of a pair of adjustable product guide rails set at a widely spaced column width setting for a package as shown in FIG. 2 and showing the product guide rails in their flipped reversed orientation in phantom for receiving a narrower food package such as the package shown in FIG. 3.

Referring now to FIGS. 8 and 11, the integral upper frame sign display structure 46 is preferably illuminated by a raised fluorescent lighting fixture 132 including a lighting base 134 and circular fluorescent bulb 136. Raising the lamp 136 in the shroud area 86 provides better back lit illumination for the upper graphics display on panels 122 and the portion of the menu panel 104.

Also shown in FIG. 11, is a thermostatically controlled forced air heater 138 which is effective to blow a flow of heated air downwardly into a flow control tube 140 (FIG. 10) and oven compartment 64. An electrical junction box 142, a blower motor housing 144 and a shroud exhaust fan 146 are also depicted. Flow control tube 140 directs the flow of hot air from the heater 138 into all levels of oven compartment 64. A hot air down-flow aperture 148 conveys blown heated air into flow control tube 140. A cooler air recycle/return aperture 150 is provided to recycle hot air from the oven back through the heater section 138.

As shown in FIGS. 8 and 10, flow control tube 140 is disposed in a rear corner location, opposite front door 58. Flow control tube 140 includes a plurality of differently shaped or configured air flow apertures 152 including enlarged oval apertures 156 disposed along the portions of the discharge tube adjacent window wall 50 and rear door 60 or rear window panel 62 (FIG. 4). Control tube 140 with its apertures 152, 156 forces the heated forced air from heater/blower 138 to substantially completely fill the interior volume of oven compartment 64 and thereafter to flow in currents designed to maintain a generally uniform oven temperature throughout compartment 64. The enlarged flow apertures 156 promote improved hot air flow adjacent windowed sidewalls of the compartment 64 to further provide enhanced uniform product heating. Moreover, the aperture pattern in flow control tube 140 has been specially designed to extend the apertures to the bottom of tube 140 and to increase the number of apertures pointed towards opposite corner 90. This effectively eliminates a relative cool spot from forming adjacent corner 90. The dimensions of compartment 64 and of rack 66 have been selected to improve uniform heating to prevent condensation from forming within the packages. Condensation may occur when the air outside of the package is relatively cooler than the air inside the package. This condition tends to occur adjacent windows where heat is dissipated more rapidly. The improved rack and oven design of this invention substantially reduces or eliminates the occurrence of condensation within the food packages. Uniform heating performance is also achieved in accordance with this invention by keeping the distance between window and rack between about 1.5 to about 3 inches, preferably at least about or equal to 2.0 inches, to promote air flow and avoid formation of relatively cool and hot spots.

In accordance with the invention, the oven display assembly 12 also includes the new and improved hot oven display rack 66 positioned in oven compartment 64 for holding or suspending the food packages 68 and 70 in the heated flow of air within compartment 64 until dispensed from the front opening 78. As shown in FIGS. 2 and 3, the packages 68 and 70 each include a lower tray portion 200, an upper cover portion 202 connected to tray portion 200 along one edge by a living hinge 204 and a releasable locking latch 206. In their closed positions, packages 68 and 70 have generally rectangular configurations including width, depth and heigth dimensions indicated as dimensions $w_1$, $l_1$, $h_1$, and $w_2$, $l_2$, and $h_2$, respectively. Each includes an outwardly projecting lateral peripheral flange portion 208 located at a point intermediate the height dimension $h_1$ or $h_2$ of the packages 68 and 70. Packages 68 and 70 are molded from a thermoplastic material capable of providing a semi-rigid package 68 or 70 which can be fully supported when filled, solely by the side portions 210 and 212 of the peripheral flange 208, i.e., without significantly sagging, buckling or bending.

Referring now to FIGS. 4, 5, 7, 9 and 12, the details of the new and improved hot oven display rack 66 are shown. Rack 66 includes a U-shaped frame 214 including a base portion 216 and left-hand and right-hand upstanding side panels 218 and 220, respectively, all having a generally rectangular open or hollow wire loop form. Rows 74 are formed by angled shelf forms, each including a left hand angled side rail 222 connected to left upstanding frame panel 218 and an aligned and opposed right-hand angled side rail 224 connected to right upstanding frame panel 220 and interconnected by a forward transverse cross member 226 and a rearward transverse cross member 228. Each shelf or row 74, includes a plane defined by angled side rails 222, 224 and transverse members 226 and 228 which plane is canted or disposed at an angled orientation with respect to the generally horizontal plane defined by the base 216 of U-shaped frame 214.

Each row or shelf 74 is further sub-divided to form the downwardly angled food product chutes or columns 72 (FIG. 1) by fixed left and right guide rails 230 and 234, and 236 and 232, respectively, and a plurality of fixed raised left and right guide rails 234, 236, and by central raised reversible removable guide rails 238 and 240. Fixed and raised left and right guide rails 234 and 236 include vertical legs 244 connecting them to the forward transverse and rearward transverse cross bar members 226 and 228. Accordingly, left hand and right hand gravity feed columns 72 are provided each adapted to slidably receive the FIG. 2 sized packages 68 having a width dimension w1. Side flange 210 rests on fixed left guide rail 230 and right side flange 212 rests and is supported on fixed raised right guide rail 234. Central reversible guide rails 238 and 240 include depending mounting feet 242 including a vertical leg spacer portion 244 and a horizontal or perpendicular rod portion 246.

In accordance with the preferred embodiment shown in FIGS. 4–5, 7 and 10 removable central guide rails 238 and 240 and are mounted onto each shelf 74 by sliding their respective horizontal rod portions 246 into hollow tubular mounting sleeves 248 or 250 affixed to forward and rearward transverse members 226 and 228. Fixed raised left side guide rails 234 include a leftward right angle hook stop finger 252 at the front end thereof. Fixed raised right side guide rails 236 include a rightward right angle hook stop 254 at the front end thereof. Reversible, removable center guide rails 238 and 240 include a first right angle hook stop 256 at one end and an oppositely directed hook stop 258 at the opposing end, best shown in FIG. 12. The hooks 258 are adapted to form forward stops for the narrower width, $w_2$, packages 70 shown in FIG. 3 when the horizontal feed rods 246 are inserted into tube mounting sleeves 250. If it is desired to put wider packages such as those having width w1 as shown in FIG. 2 in the center column 72 of each row 74, the reversible guides 238 and 240 are flipped around so that the right angle hooks 256 face the front side 76 of the rack 66 and their horizontal feet rods 246 are inserted into tube mounting sleeves 248 instead of sleeves 250 as is indicated in solid line position in FIG. 12. The columns 72 are defined by the raised pairs of guide rail members i.e., 230 and 234; 238 and 240; and 236 and 232. The package flange portions 210 and 212 are slidably received on the smooth and polished guide rail surfaces. The guide rails surfaces are set at a forwardly and downwardly sloping angle to provide assured gravity feed for the packages to ensure that they will slide until abutting contact with the forward stop hooks 252, 254, 256 or 258 and/or the frame intersection at 300 or 201 is made. The slope of the shelves may vary, but generally should be between about 5 to about 60°, and preferably will vary between about 10° and about 45° to provide good slip and front self facing performance for the packages.

As is best shown in FIG. 4, the only heated rack surfaces disposed at the front opening 78 of the display oven are the small hook stop portions 252, 254, 256 and/or 258. These hook stops are disposed at a recessed location at the underside of each flange 208 of each of the forward most packages 68 or 70 in the front of each column 72. As a result, little or no exposed heated surfaces are presented to a customer desiring to grab a package in the center and to remove it.

Further details of the special flanged packages 68 and 70 may be found in the co-pending applications, 451,433 filed Dec. 15, 1989 and U.S. Ser. No. 687,266 filed Apr. 18, 1991, the disclosures of which are specifically incorporated herein by reference. The method and materials for making the new and improved rack 66 and the display oven 12 are generally within the skill of those persons knowledgeable in the art.

Figure 5:
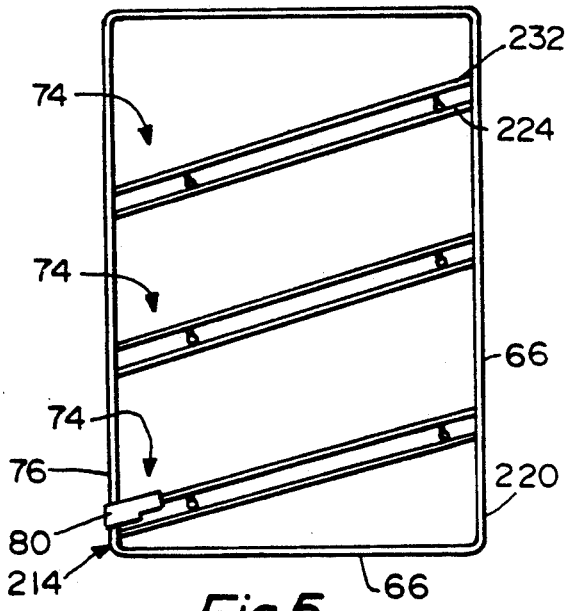
FIG. 5 is a side elevation view of the new and improved hot food display rack of the present invention.
Figure 7:
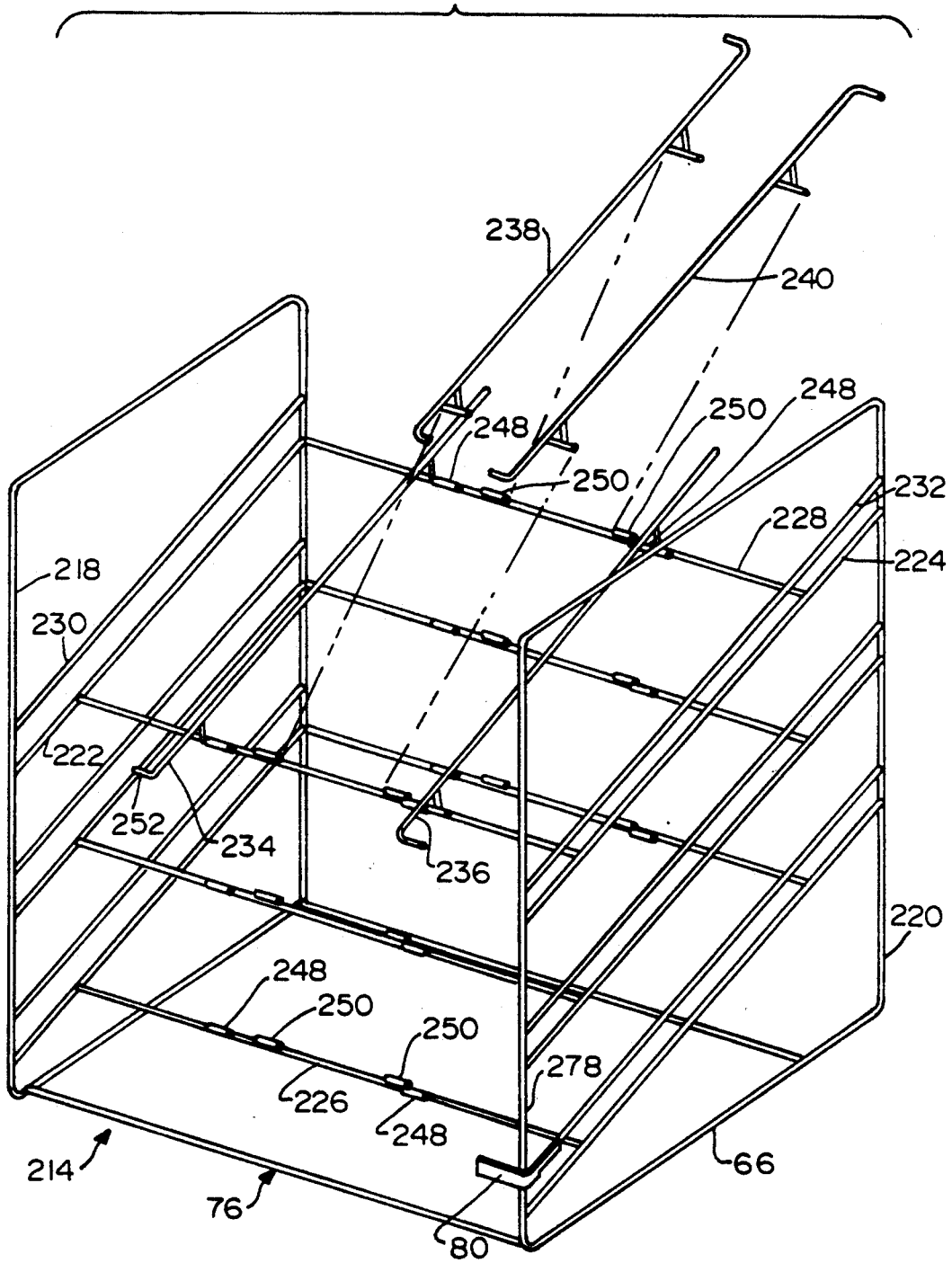
FIG. 7 is a perspective view of the new and improved hot food display rack of the present invention shown with its product width-adjustable, removable product-receiving guide rails in an exploded condition prior to assembly to the rack frame with other column forming guide rails removed from the lower tier shelves for improved clarity.
Figure 9:
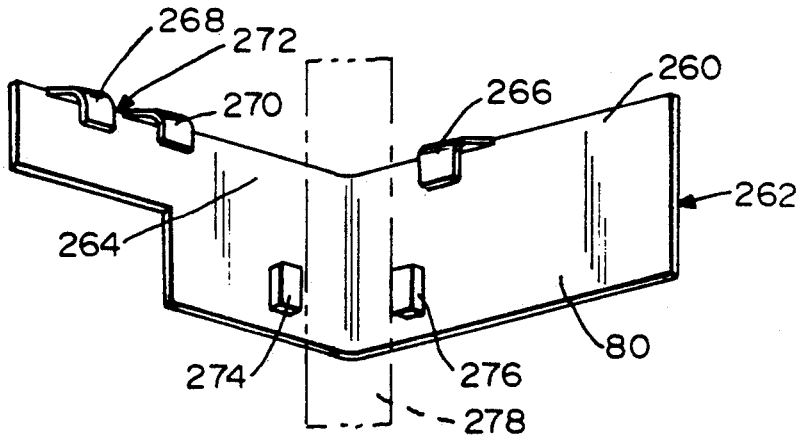
FIG. 9 is an elevated rear side perspective view of the new and improved clip-on I.D. tag members attachable to the display rack of the invention for identifying food products in each column and row presented in the rack and oven.

Referring now to FIGS. 1, 7 and 9, a new and improved rack column I.D. clip tag 80 is shown. As depicted in FIG. 9, clip tag 80 includes a front I.D. label arm 260 adapted to be disposed parallel to the front oven opening 78 so that its front side surface 262 having indicia printed or etched thereon (not shown), faces outwardly toward front door 58. Tag 80 also includes a side stabilizer arm 264. Label arm 260 has a single spring clip finger 266 defined thereon for clipping and holding a right angled stop finger 252, 256 or 258. Side arm 264 includes a pair of spring clip fingers 268, 270 adapted to clip and engage right fixed guide rails 232, as well as portions of raised guide rails 234 and 240. The top surface 272 of side arm 264 is smooth and spring fingers 268 and 270 have a tapered leading edge or chamfer in this area to permit packages 68 and 70 to freely slide over tag 80. On the right hand row 74, as shown in FIGS. 1, 5, 7 tag 80 fastens to the outer side of frame right side panel 220. Rectangular protrusions 274 and 276 of FIG. 9 provide an interference fit around the front verticle leg 278 of right side panel 220 to aid in retaining tag 80 in properly facing attached position.

Although the present invention has been described with reference to certain preferred embodiments, modifications or changes may be made therein by those skilled in this art. For example, instead of mounting the guide rails to the transverse members by means of depending feet received in sleeves soldered onto the transverse members, other adjustable mounting means may be used, such as by providing grooved slots adapted to position and receive foot portions of the guide rails. Instead of providing a pass through double-doored oven, a single front door may be used, in which case, it may be necessary to provide a turntable surface to support the display rack at the floor of the oven so that the rack can be turned to permit rear loading of new packages in the channels. A slide or drawer arrangement may also be provided to allow the rack to be fully pulled out of the oven to permit re-loading. All such obvious modifications and changes may be made herein by those skilled in this art without departing from the scope and spirit of this invention as defined by the appended claims.

We claim:

1. A hot food countertop self-service display station comprising: a countertop display oven including an oven body defining a generally rectangular heated oven compartment having a reclosable, side-opening, hinged front door panel for covering a generally rectangular front opening and an upright, vertical elongate forced air flow control tube disposed in a corner location in said oven compartment opposite said front door panel, said flow control tube including means for directing air flow in said oven compartment, means for supplying a flow of heated forced air into said flow control tube and throughout said oven compartment, means for thermostatically controlling air temperature connected to said hot air supply for maintaining the temperature of said oven compartment at a generally constant range of temperatures and rack means adapted to be placed in said oven compartment and effective to sub-divide said compartment into a gravity feed, self-facing array of columns and rows of product packages disposed at said front opening, said rack means including stop means adjacent said front opening for each package position in said array and positioned to prevent packages placed in said rack from sliding forwardly out of said array of columns and rows at said front opening, each said stop means being located in such manner that heated rack surfaces are recessed from said front opening, away from the center of each package presented in the array, thereby permitting a person to grab a package in the center and remove the package from a column or row of said array at the front opening generally without being burned.

2. A display station as defined in claim 1, wherein said display oven body is of a pass-through type including a hinged rear door panel opposite said hinged front door panel.

3. A display station as defined in claim 1, wherein said means for directing air flow in said flow control tube comprises a plurality of air flow apertures configured to provide flow currents for maintaining a generally uniform oven temperature throughout said oven compartment.

4. A display station as defined in claim 3, wherein said plurality of air flow apertures further includes means for substantially preventing condensation from forming within packages displayed in said oven compartment.

5. A display station as defined in claim 1, further comprising a condiment server disposed on said countertop immediately adjacent said display oven, said condiment server including a body member having a stepped configuration including an upper tier portion and a lower tier portion, said upper tier including receptacle means for receiving rectangular trays adapted to receive loose fresh condiments, said lower tier including receptacle means for receiving hand-pump equipped liquid condiment supply bays; said body member further including a bin storage means for receiving and dispensing condiment envelopes disposed rearwardly and above said upper tier portion, and means provided within said body portion for maintaining condiments provided in said trays and supply bays at chilled temperatures below room temperature.

6. A hot food countertop self service display station comprising: a countertop display oven including an oven body defining a generally rectangular heated oven compartment having a reclosable hinged front door panel for covering a generally rectangular front opening, means for supplying a flow of heated forced air into said oven compartment, thermoplastic temperature control means connected to said hot air supply for maintaining the temperature of said oven compartment at a generally constant range of temperatures and rack means adapted to be placed in said oven compartment and effective to sub-divide said compartment into a gravity feed, self facing array of columns and rows of product packages disposed at said front opening, said rack means including a stop means adjacent said front opening for each package position in said array and positioned to prevent packages placed in said rack from sliding forwardly out of said array of columns and rows at said front opening in such manner that heated rack surfaces are recessed from said front opening, thereby permitting a person to remove the package from a column or row of said array at the front opening generally without being burned; and further comprising a condiment server disposed on said countertop immediately adjacent said display oven, said condiment server including a body member having a stepped configuration including an upper tier portion and a lower tier portion, said upper tier including receptacle means for receiving rectangular trays adapted to receive loose fresh condiments, said lower tier including receptacle means for receiving hand-pump equipped liquid condiment supply bays, said body member further including a bin storage means for receiving and dispensing condiment envelopes disposed rearwardly and above said upper tier portion, and means provided within said body portion for maintaining condiments provided in said trays and supply bays at chilled temperatures below room temperature.

* * * * *